US010312010B2

(12) United States Patent
Oga et al.

(10) Patent No.: US 10,312,010 B2
(45) Date of Patent: Jun. 4, 2019

(54) COIL COMPONENT

(71) Applicant: TAIYO YUDEN CO., LTD., Taito-ku, Tokyo (JP)

(72) Inventors: Tetsuya Oga, Takasaki (JP); Kazuhiko Otsuka, Takasaki (JP); Yuji Shibuya, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 32 days.

(21) Appl. No.: 15/470,626

(22) Filed: Mar. 27, 2017

(65) Prior Publication Data

US 2017/0287614 A1 Oct. 5, 2017

(30) Foreign Application Priority Data

Mar. 31, 2016 (JP) ..... 2016-073417

(51) Int. Cl.

| | |
|---|---|
| ***H01F 27/29*** | (2006.01) |
| ***H01F 17/04*** | (2006.01) |
| ***H01F 21/06*** | (2006.01) |
| ***H01F 27/38*** | (2006.01) |
| ***H01F 3/14*** | (2006.01) |
| ***H01F 27/26*** | (2006.01) |
| *H01F 17/00* | (2006.01) |

(52) U.S. Cl.

CPC ..... *H01F 17/043* (2013.01); *H01F 3/14* (2013.01); *H01F 17/041* (2013.01); *H01F 17/045* (2013.01); *H01F 21/065* (2013.01); *H01F 27/263* (2013.01); *H01F 27/29* (2013.01); *H01F 27/292* (2013.01); *H01F 27/38* (2013.01); *H01F 2017/0093* (2013.01)

(58) Field of Classification Search

USPC ..... 336/192, 83, 233

See application file for complete search history.

(56) References Cited

FOREIGN PATENT DOCUMENTS

JP 2001338818 A 12/2001

*Primary Examiner* — Mang Tin Bik Lian
*Assistant Examiner* — Kazi S Hossain
(74) *Attorney, Agent, or Firm* — Law Office of Katsuhiro Arai

(57) ABSTRACT

In an embodiment, a coil component 10 has a drum core 20 housed in a through hole 32 of a ring core 30, and two types of securing parts are provided in a gap G between an outer circumference of one flange part 24 of the drum core 20 and an inner circumference of the through hole 32. Terminal electrodes 50A, 50B connecting to ends 46A, 46B pulled out from a winding wire 40 wound around the drum core 20 are assembled to the ring core 30. Second securing parts 60A, 60B are arranged to opposite to each other with respect to a center C of the flange part 24, and first securing parts 62A, 62B are provided to cover an outer side of the second securing parts 60A, 60B. A hardness of the second securing part is higher than that of the first securing part.

10 Claims, 7 Drawing Sheets

FIG. 5A-1
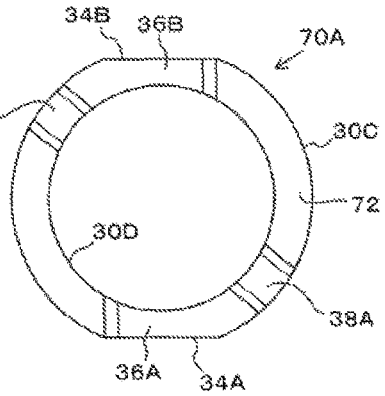
FIG. 5B-1
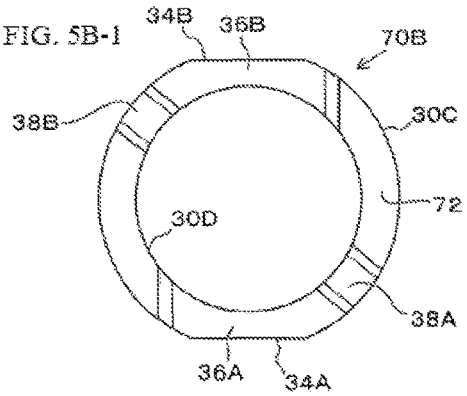
FIG. 5B-2
FIG. 5A-2
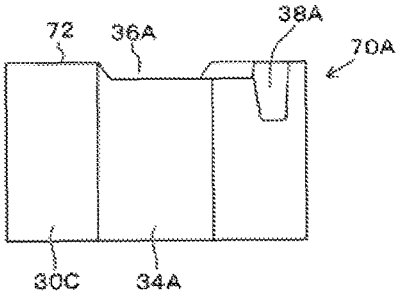
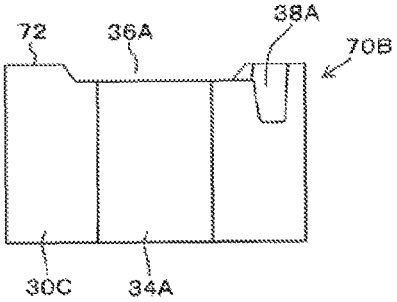
FIG. 5A-3
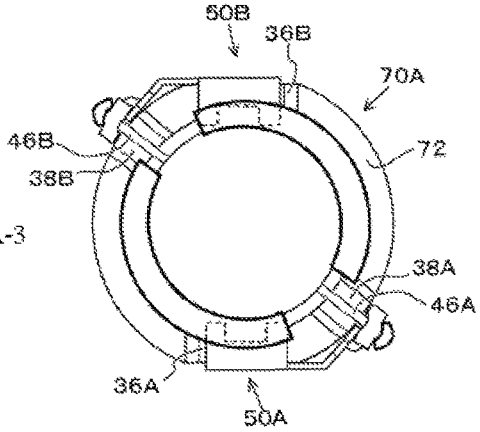
FIG. 5B-3
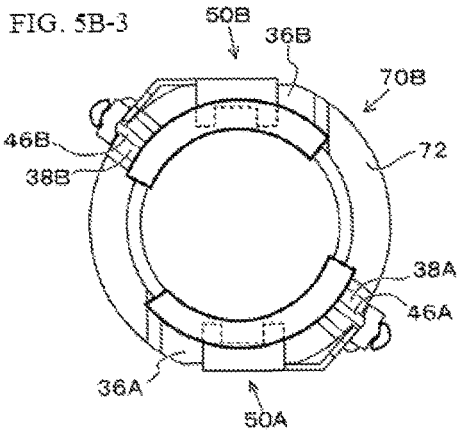

COIL COMPONENT

BACKGROUND

Field of the Invention

The present invention relates to coil components, and more specifically, to a coil component in which a drum core is housed in a through hole of a ring core (annular core).

Description of the Related Art

In recent years, applications for electronic components have expanded and demands on stability against environmental fluctuation have been increasing. In particular, the adopted number of electronic components is ever increasing with movement toward computerization in the field of automobiles, and an electronic component such as a coil that does not break with respect to temperature fluctuation and vibration is desired. For a coil component, one with a structure in which a drum core, around which a winding wire is wound, is housed in a through hole of a ring core (or sleeve core) is known. For such a coil component including a core in which the drum core and the ring core are combined, there is, for example, an "inductance element" described in Patent Literature 1. The Literature discloses that by adopting a constitution of applying adhesive entirely along an inner circumferential surface of the ring core between an upper end flange and the drum core and the ring core, an impact does not concentrate at one specific portion but is substantially evenly dispersed between the drum core and the ring core.

BACKGROUND ART LITERATURES

[Patent Literature 1] Japanese Unexamined Patent Publication No. 2001-338818

SUMMARY

However, as described in Patent Literature 1, although a method of applying the adhesive over the entire circumference of a gap between the ring core and the drum core can expect effects with respect to an impact, there are problems in that it is very difficult to evenly apply the adhesive over the entire circumference and in it being easily subjected to influence with respect to heat stress. For example, in the method of applying the adhesive over the entire circumference, the cores (drum core and ring core) cannot be easily positioned, and the gap between the cores becomes uneven and a large gap and a small gap are formed therebetween, where the extent/distribution of stress exerted on the cores may change depending on the size of the gap. In particular, when using a thick conductive wire, the position of the drum core may move by processing a lead wire of the conductive wire. Thus, it is not easy to obtain a coil component having both high reliability and stability of properties with the conventional method.

The present invention focuses on the above aspects, and aims to provide a coil component having a core structure in which a drum core and a ring core are combined, and having both high reliability and stability of properties.

Any discussion of problems and solutions involved in the related art has been included in this disclosure solely for the purposes of providing a context for the present invention, and should not be taken as an admission that any or all of the discussion were known at the time the invention was made.

The present invention is characterized by including a drum core having a pair of flange parts at both ends of a winding shaft; a conductive wire wound around the winding shaft; a ring core having a gap with respect to one of the flange parts as viewed in an axial direction of the winding shaft, and having a through hole housing the drum core therein; a terminal electrode electrically connected to the conductive wire; a first securing part provided at a part of the gap between the one flange part of the drum core and the ring core; and a second securing part provided at a part of a portion of the gap where the first securing part is not provided, and having a higher hardness than that of the first securing part.

According to one main aspect of the present invention, the first securing part covers an outer side of the second securing part. According to another aspect, a length of the first securing part in contact with an outer circumferential surface of the flange part of the drum core is 60% or more of a length of the outer circumferential surface of the flange part of the drum core. According to another further aspect, a hardness of the second securing part is greater than or equal to $50N/cm^2$ in Shore D hardness.

According to yet another further aspect, at least two or more second securing parts are provided. According to another further aspect: (1) at least two of the second securing parts are arranged at positions facing each other with respect to a center of the drum core; (2) The second securing parts are arranged line-symmetrically with respect to a line passing through a center of the drum core; (3) The second securing parts are arranged at equal intervals.

According to another further aspect, the first securing part and the second securing part are arranged on a flange part side opposite a surface on which the terminal electrode is mounted. The above described and other objects, features, and advantages of the present invention should be apparent from the following detailed description and the accompanying drawings.

According to the present invention, a coil component comprises: a drum core including a pair of flange parts at both ends of a winding shaft; a conductive wire wound around the winding shaft; a ring core having a gap with respect to one of the flange parts as viewed in an axial direction of the winding shaft, and having a through hole housing the drum core therein; a terminal electrode electrically connected to the conductive wire; a first securing part provided at a part of the gap between the one flange part of the drum core and the ring core; and a second securing part provided at a part of a portion of the gap where the first securing part is not provided, and having a higher hardness than that of the first securing part. Thus, the fluctuation in the distance between the drum core and the ring core can be suppressed, and the coil component having both high reliability and stability of properties can be obtained.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1A is an outer appearance perspective view seen from an opposite side of a mounting surface, FIGS. 1B to 1D are views schematically showing a position relationship of a first securing part and a second securing part, and FIG. 1E is a cross-sectional view taken along line 1E-1E in FIG. 1C.

FIG. 2A-1 is a plan view of a drum core, FIG. 2A-2 is a side view of the drum core, FIG. 2B-1 is a plan view of a ring core, FIG. 2B-2 is a side view of the ring core, and FIG. 2C is a perspective view showing a state in which a terminal electrode is incorporated in the ring core.

FIGS. 5A-1 to 5B-3 are views showing another example of the present invention.

DESCRIPTION OF THE SYMBOLS

Figure 1A:
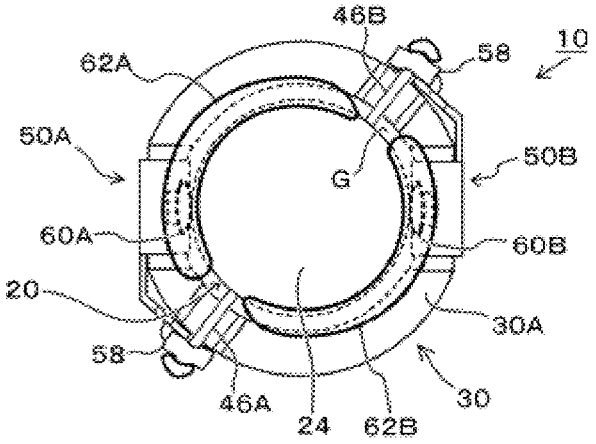
FIGS. 1A to 1E are views showing a coil component of an example of the present invention, where

10, 10', 10A to 10D coil component
20 drum core
22 winding shaft
24, 26 flange part
24A front surface
26A front surface
30 ring core
30A upper surface
30B bottom surface
30C outer circumferential surface
30D inner circumferential surface
32 through hole
34A, 34B parallel surface
36, 36A, 36B, 38A, 38B step difference (or groove)
40 winding wire
42 conductive wire
44 coating
46A, 46B end
50A, 50B terminal electrode
52 side face
52A upper surface part
52B bottom surface part
54A, 54B nail part
56 extended part
58 connecting part
60A to 60D second securing part
62, 62A to 62C first securing part
64 chamfered part
66 tapered part
70A, 70B ring core
72 upper surface
C center of drum core
D1 outer diameter of drum core
D2 inner diameter of ring core
G gap
L line passing through center of drum core

DETAILED DESCRIPTION OF EMBODIMENTS

The best mode for carrying out the present invention is described in detail below with reference to examples.

EXAMPLES

Figure 1B:
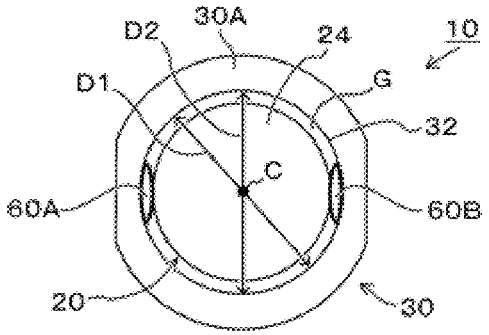
Figure 1C:
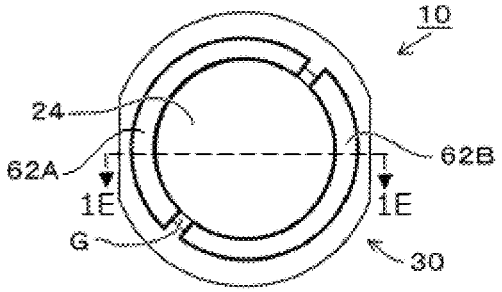
Figure 1D:
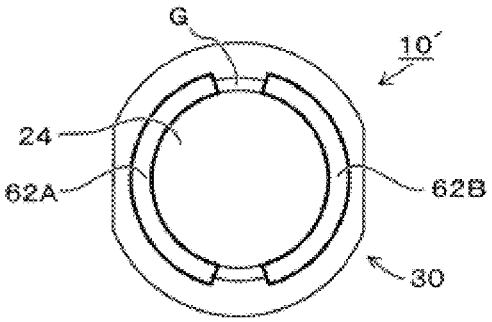
Figures 1, 2A:
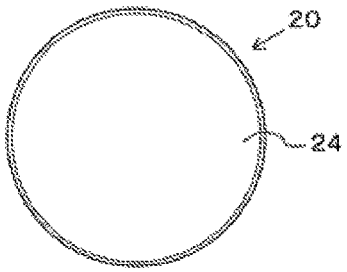
FIGS. 2A-1 to 2C are views showing the example, where
Figures 2, 2A:
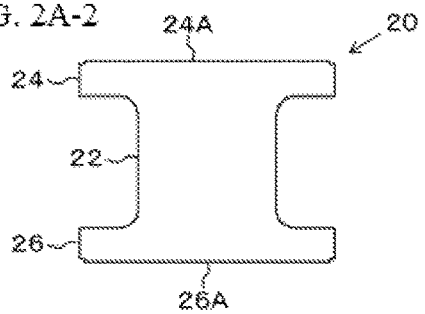
Figures 1, 2B:
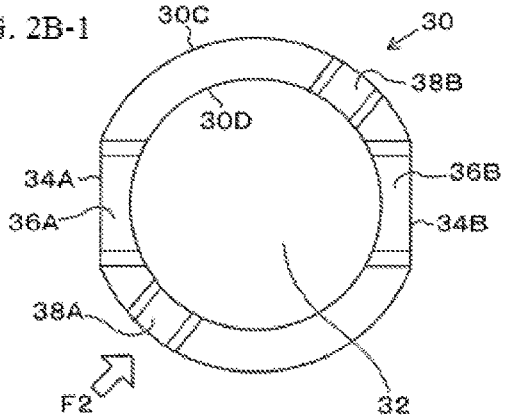
Figures 2, 2B:
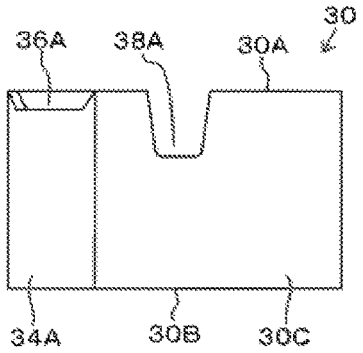
Figure 2C:
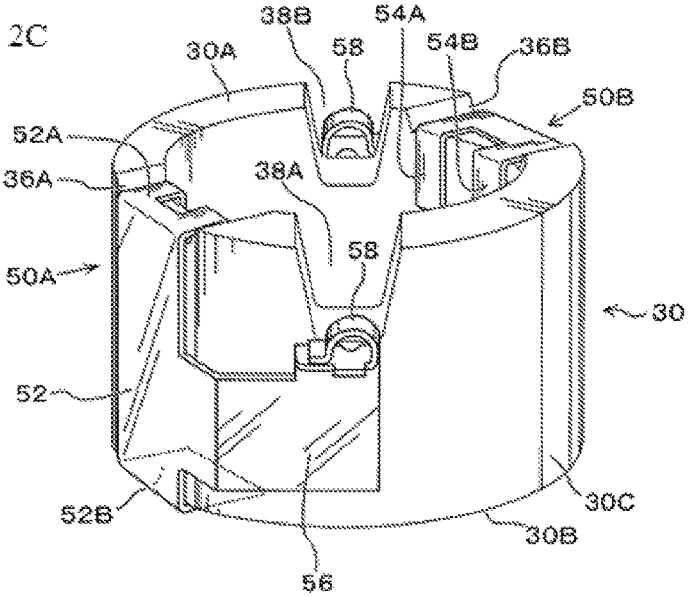

First, an example of the present invention is described with reference to FIGS. 1A to 3F. The present invention relates to a coil component having a core structure in which a drum core, around which a conductive wire is wound, is housed in a through hole of a ring core. FIG. 1A is an outer perspective view seen from an opposite side of a mounting surface, and FIGS. 1B to 1D are views schematically showing a position relationship of a first securing part and a second securing part in the present example. FIG. 2A-1 is a plan view of a drum core of the present example, FIG. 2A-2 is a side view of the drum core, FIG. 2B-1 is a plan view of a ring core of the present example, FIG. 2B-2 is a side view of the ring core seen from a direction of arrow F2, and FIG. 2C is a perspective view showing a state in which a terminal electrode is incorporated in the ring core. FIGS. 3A to 3F are views showing a manufacturing procedure of the coil component of the example.

Figure 1E:
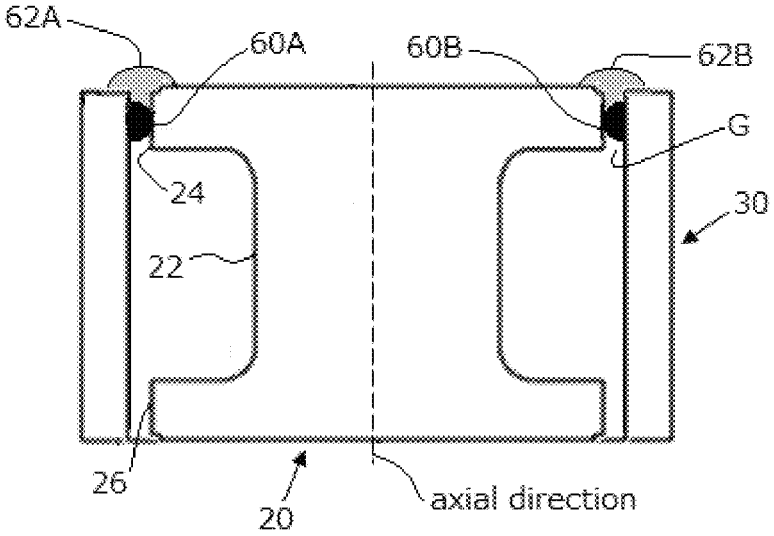

As shown in FIGS. 1A to 3F, a coil component 10 of the present example has a structure in which a drum core 20 is housed in a through hole 32 of a ring core 30 (referred to also as an annular core or a sheath core), and two types of securing parts are provided between the drum core and the through hole 32, that is, in a gap G between an outer circumference of a flange part 24 of the drum core 20 and an inner circumference of the through hole 32 of the ring core 20. Also, terminal electrodes 50A, 50B connecting to ends of a winding wire 40 wound around the drum core 20 are provided on an outer circumferential surface 30C of the ring core 30. As schematically shown in FIG. 1B, the second securing parts 60A, 60B are provided at two areas so as to face each other with a center C of the flange part 24 of the drum core 20 in between. And, as shown in FIG. 1C, the first securing parts 62A, 62B are provided in an arcuate form so as to cover the portion where the second securing parts 60A, 60B are provided (FIG. 1E is a cross sectional view taken along line 1E-1E in FIG. 1C). The first securing parts 62A, 62B merely need to cover the outer side (the upper side opposite to the mounting side) of the second securing parts 60A, 60B, and for example, an arrangement such as the coil component 10 shown in FIG. 1D may be adopted. In the present invention, the second securing part having a higher hardness than the first securing part is used.

Next, each portion constituting the coil component 10 is described in detail. As shown in FIGS. 2A-1 and 2A-2, the drum core 20 constituting one part of the core includes a pair of flange parts 24, 26 at both ends of a winding shaft 22 around which the winding wire 40 is wound. In the present example, the winding shaft 22 and the flange parts 24, 26 have a substantially circular cross-sectional shape in a direction orthogonal to an axial direction of the winding shaft 22. The winding wire 40 has a conductive wire 42 covered with a coating 44 having an insulation property (see FIG. 3C).

As shown in FIGS. 2B-1 and 2B-2, the ring core 30 is a hollow body including the through hole 32, where a cross-section of the through hole 32 perpendicular to its axis is substantially circular, and a cross-section of an outer shape of the ring core 30 perpendicular to its axis has a shape in which a part of a circle is removed. In the illustrated example, parallel planes 34A, 34B extending along the axial direction are provided at positions opposite to each other with respect to the center in between on the substantially cylindrical outer circumferential surface 30C. And, a dimension of the inner circumference of the ring core 30 is greater than a dimension of the outer circumference of the drum core 20, where the drum core 20 is housed in the through hole 32 with the gap G (FIG. 1B).

Also, on an upper surface 30A side of the ring core 30, step differences (or grooves) 36A, 36B are provided so that an upper surface part 52A of the terminal electrodes 50A, 50B does not project out from the upper surface 30A, and step differences (or grooves) 38A, 38B for pulling out ends 46A, 46B of the winding wire 40 are formed. In the present example, as shown in FIG. 2C, the step differences 36A, 36B for housing the upper surface part 52A of the terminal electrodes 50A, 50B are formed at the upper surface part continuing to the plane parts 34A, 34B, and the deep step differences 38A, 38B for pulling out the ends 46A, 46B of the winding wire 40 (FIGS. 3C, 3D, 3E-1) are formed on the upper surface part so as to be proximate to the step differences 36A, 36B, respectively. Also, the thickness in the height direction can be increased as the adhesive enters the inner side of such step differences.

Next, the terminal electrodes 50A, 50B are described. The terminal electrodes 50A, 50B basically have a same configuration, and thus one terminal electrode 50A is described as an example. In the present example, the terminal electrode 50A is attached so as to lie along the outer circumferential surface 30C from the plane parts 34A, 34B of the ring core 30. As shown in FIG. 2C, the terminal electrode 50A includes a side face 52, an extended part 56 extended toward the side from the side face 52, and an upper surface part 52A and a bottom surface part 52B continuously formed with respect to the side face 52. Also, a pair of nail parts 54A, 54B divided into two from the upper surface part 52A is continuously formed on the side face 52 and a connecting part 58 for connecting with the lead part of the winding wire 40 is continuously formed on the extended part 56.

Such terminal electrode 50A is, for example, formed to a shape that can be attached to the ring core 30 by bending and caulking one metal plate including the side face 52, the upper surface part 52A, the nail parts 54A, 54B, the extended part 56, the connecting part 58, and the bottom surface part 52B at a predetermined position. In the illustrated example, the side face 52 lies along the plane part 34A of the ring core side surface, the upper surface part 52A lies along the step difference 36A of the ring core 30, the nail parts 54A and 54B lie along an inner circumferential surface 30D of the through hole 32 of the ring core 30, the bottom surface part 52B lies along a ring core bottom surface 30B, and the extended part 56 lies along the outer circumferential surface 30C of the ring core. It should be noted that in FIG. 2C, the connecting part 58 is shown in an already bent state, but actually, the ends 46A, 46B of the winding wire 40 are pulled out onto the connecting part 58 and then bent. The other terminal electrode 50B also has the same structure, where the terminal electrode 50B is attached to the plane part 34B of the side surface of the ring core 30 by bending, caulking, and the like. It should be noted that the bottom surface part 52B is a surface on a mounting side.

Figure 3A:
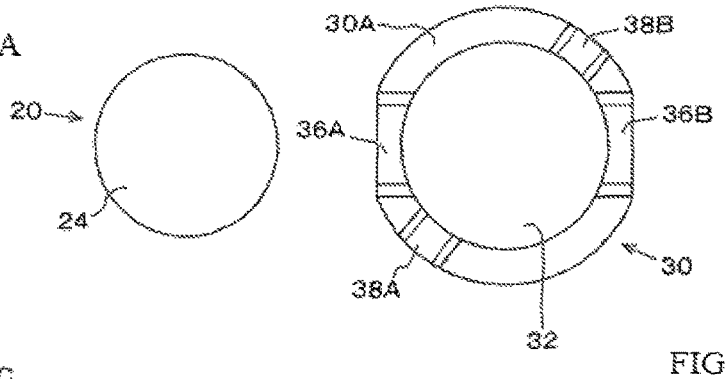
FIGS. 3A to 3F are views showing a manufacturing procedure of the coil component of the example.
Figure 3B:
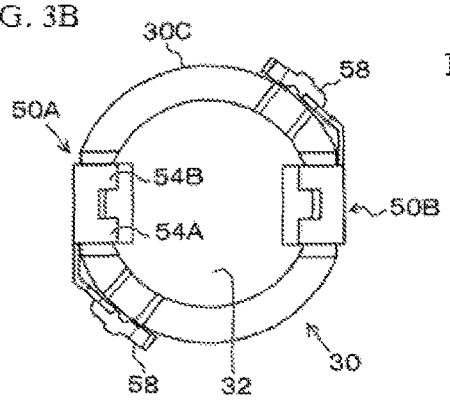
Figure 3C:
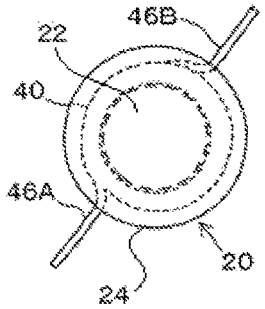

Next, one example of a manufacturing method of the coil component 10 of the present example is described with reference to FIGS. 3A to 3F. First, as shown in FIG. 3A, the drum core 20 and the ring core 30 described above are prepared, and then the terminal electrodes 50A, 50B are assembled to the ring core 30 in advance by bending, caulking, and the like, as shown in FIG. 3B. At this point, the connecting part 58 of the terminal electrodes 50A, 50B is not folded back. Next, as shown in FIG. 3C, the winding wire 40 for example, a round wire with a circular cross-section including a coating 44 is wound around the winding shaft 22 of the drum core 20 so as to overlap the conductive wires along the winding shaft 22 from one side. The winding wire 40 is wound around the circumference of the winding shaft 22, and both ends 46A, 46B are pulled out from the outer circumference on the flange part 24 side of the drum core 20. The pulled-out ends 46A, 46B are shaped to match the connecting positions with the terminal electrodes 50A, 50B.

Here, both ends 46A, 46B have the heights aligned to lie along the inner side of one flange part 24 of the drum core 20 (FIG. 3C), and are shaped so that the respective ends 46A, 46B are directed in opposite directions toward the outer side in the circumferential direction from the drum core 30. In other words, such ends 46A, 46B are on a substantially straight line when one end (e.g., end 46B) is viewed from the other end (e.g., end 46A). If the ends 46A, 46B are on a straight line, the stripping of the coating in the next and subsequent steps can be accurately carried out, and the joining stability can be enhanced.

Figure 3D:
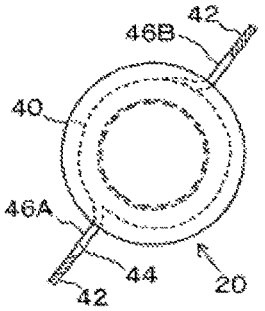

Then, as shown in FIG. 3D, the coating 44 at the position connecting to the terminal electrodes 50A, 50B is stripped from the ends 46A, 46B pulled out from the winding wire 40. The stripping of the coating is, for example, carried out by irradiating an outer circumferential surface of the winding wire ends 46A, 46B with a green laser from one direction, and then turning the wound drum core 20 around by 180 degrees and again irradiating the same with laser. Thus, the green laser is irradiated from two directions differing by an angle of 180 degrees, so that the coating 44 over the entire circumference of the conductive wire 42 of the winding wire ends 46A, 46B can be removed.

The drum core 20, around which the winding wire 40 is wound and stripped of its coating 44 from the ends 46A, 46B in the above manner, is housed in the through hole 32 of the ring core 30, and positioned so that the respective centers coincide. In the positioning, the outer circumferential surfaces of the drum core 20 and the ring core 30 are image-recognized, and the position of the drum core 20 is adjusted. In this state, a UV adhesive is applied to two points between the outer circumferential surface of the flange part 24 of the drum core 20 and the inner circumferential surface of the ring core 30 using a dispenser from the upper surface side of the drum core 20, that is, the side opposite the mounting surface (upper surface 24A side of the flange part 24 in the present example), and cured with a UV lamp. In this case, the UV adhesive may be applied to one part of the terminal electrodes 50A, 50B. In the present example, the UV adhesive is applied so as to include the upper surface part 52A side of the terminal electrodes 50A, 50B.

The applied and cured UV adhesive becomes the second securing parts 60A, 60B. The second securing parts 60A, 60B are fixed at the position where the drum core 20 and the ring core 30 are positioned. The fluctuation in the position between subsequent steps and during a subsequently-conducted environment test, and the like thus can be suppressed. Also, in the illustrated example (see FIG. 3E-1), the securing parts are arranged at plural areas (two areas), and located at positions opposite to each other with respect to the center of the drum core 20, so that the stress applied on the ring core 30 also becomes even.

Figures 1, 3E:
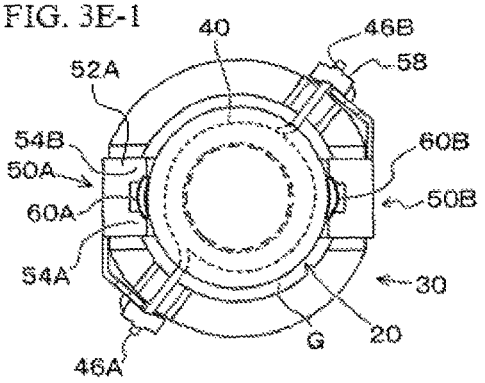
Figures 2, 3E:
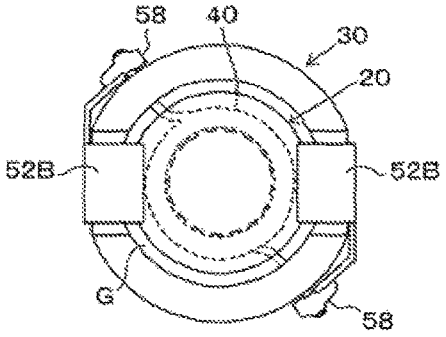

Next, as shown in FIG. 3E-1, the terminal electrodes 50A, 50B and the conductive wire 42 of the winding wire ends 46A, 46B are joined. FIG. 3E-2 is a view in which FIG. 3E-1 is turned upside down. As shown in FIG. 3E-2, the lower surface (front surface 26A of the flange part 26 in the present example) side of the drum core 20 is held by the bottom surface part 52B of the terminal electrodes 50A, 50B. The ends 46A, 46B of the winding wire 40 are connected to the terminal electrodes 50A, 50B and cut at appropriate position.

Figure 3F:
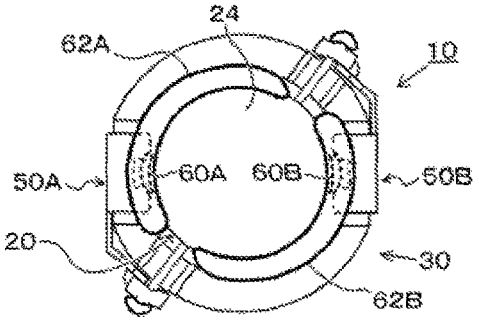

Lastly, as shown in FIG. 3F, a thermosetting adhesive is applied using the dispenser so as to cover the upper surface (outer side) of the second securing parts 60A, 60B in the gap G between the drum core 20 and the ring core 30, and cured at approximately 150° C., for example. The cured thermosetting adhesive becomes the first securing parts 62A, 62B (which directly contact the upper side of the second securing parts 60A, 60B as shown in a cross-sectional view of FIG. 1E). Thus, as the first securing parts 62A, 62B cover the second securing parts 60A, 60B, the thickness in the height direction of the first securing parts 62A, 62B can be ensured at a portion that does not overlap the second securing parts 60A, 60B, and that makes contact with the outer circumferential surface (of the flange part 24) of the drum core 20. Also, the portion where the thickness is ensured can be made long, and defects such as stripping can be suppressed by setting the length of the portion making contact with the first securing parts 62A, 62B and the outer circumferential surface of the drum core 20 long. Therefore, the length of the portion making contact with the second securing parts 60A, 60B and the outer circumferential surface of the drum core 20 can be included, where the proportion of the length of the portion making contact with the first securing part 62 (wherein the first securing parts 62A, 62B, etc. are hereinafter referred to collectively as the first securing part 62) and the outer circumferential surface of the drum core 20 is preferably greater than or equal to 60% with respect to the length of the outer circumferential surface of the drum core 20. It should be noted that with respect to the overlapping portion of the first securing parts 62A, 62B and the second securing parts 60A, 60B, the length of the portion making contact with the second securing parts 60A, 60B and the outer circumferential surface of the drum core 20 is included in the length of the portion making contact with the first securing part 62 and the outer circumferential surface of the drum core 20.

Figure 4A:
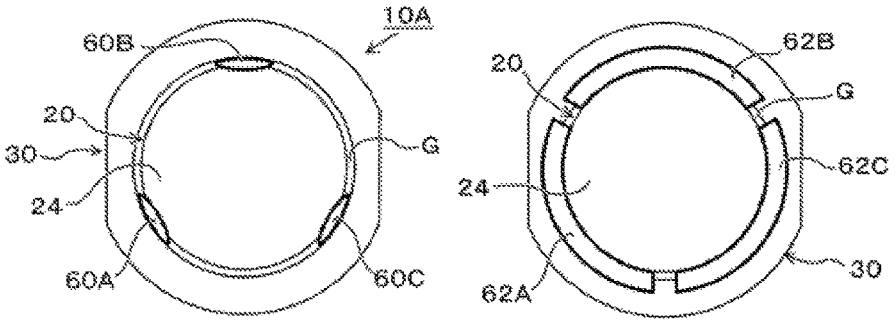
FIGS. 4A to 4F are views showing another example of the present invention.
Figure 4B:
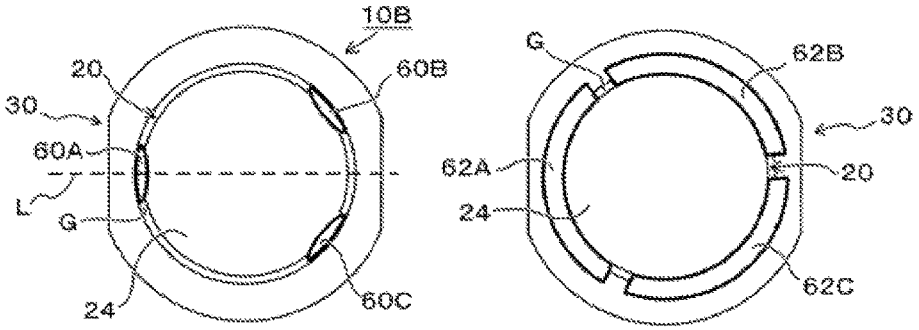
Figure 4C:
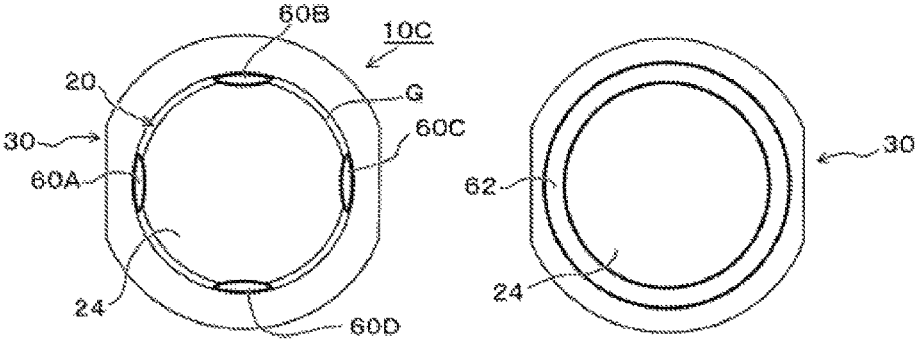
Figure 4D:
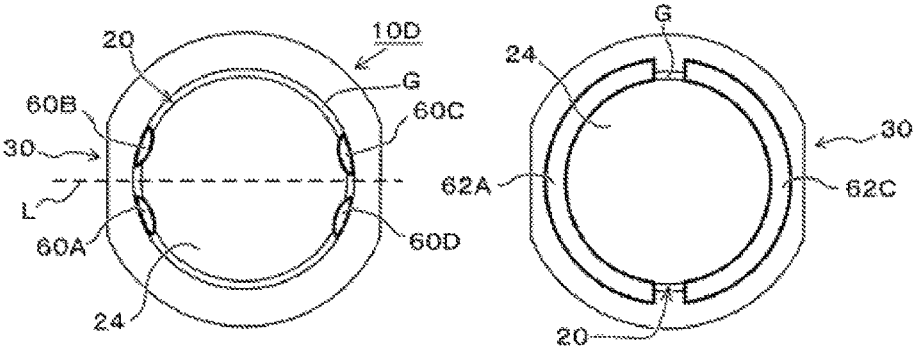
Figure 4E:
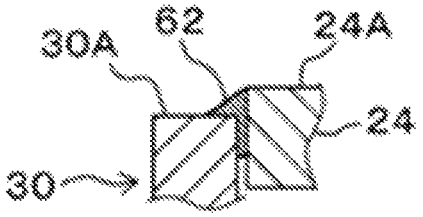
Figure 4F:
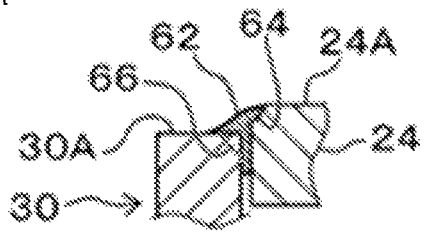

Also, in the present example, as shown in FIG. 4C, the first securing part 62 may be formed over the entire outer circumferential surface of the drum core 20, but is actually better to be formed by smaller than or equal to 90% of the entire outer circumferential surface of the drum core 20 since a portion where the first securing part does not exist needs to be provided in order to allow the stress to be effectively released. Furthermore, by providing a step difference on the upper surface 24A and the outer circumferential surface of the drum core 20, or on the upper surface 30A and the inner circumferential surface of the ring core 30, the adhesive can be thickened at the relevant portion, so that the relevant portion can act as a reservoir for the adhesive thus preventing wet-spreading, and leading to satisfactory stability of the shape of the adhesive and facilitation of image recognition. Such modes will be described later, but in the present example, a slightly chamfered part 64 is provided at the upper surface of the drum core 20, that is, at the outer edge portion of the front surface 24A of the flange part 24, and the thickness of the adhesive can be secured using such chamfered part 64, as shown in FIGS. 2A-2 and 4F.

In the present example, two types of adhesives are used, where the adhesive with higher hardness after curing is used for the adhesive to become the second securing parts 60A, 60B than for the adhesive to become the first securing parts 62A, 62B, and the adhesive with lower linear coefficient of expansion after curing is used for the adhesive (thermosetting adhesive) to become the first securing parts 62A, 62B than for the adhesive to become the second securing parts 60A, 60B. If the second securing parts 60A, 60B have a Shore D hardness of greater than or equal to 50 N/cm$^2$, the position of the core will not move. Also, the first securing parts 62A, 62B merely need to have a linear coefficient of expansion of lower than or equal to $2\times10^{-5}$/K, and low-UV adhesive, thermosetting adhesive, and the like can be used. In addition, the conditions other than the linear coefficient of expansion include a glass transition point of greater than or equal to 150° C., and a viscosity before curing of greater than or equal to 80000 mPa·s. The thickness (depth) of the adhesive can be easily obtained even in one application, and the adhesive can be subjected to applications under high temperature of 150° C. when the above conditions are met.

<Test Samples>

Next, test samples of the present example are described. Coil components of a comparative example and test samples 1 to 6 were produced under the conditions shown in table 1 below, and variation (%) of inductance as well as defects after a heat cycle test were checked. The coil component 10 was a wound wire type inductor having a dimension of 10.5×10×5 mm, where Ni—Zn ferrite was used for the drum core 20 and the ring core 30, which are magnetic bodies. In this gap design between the drum core 20 and the ring core 30, the distance of the outer circumferential surface of the flange part 24 and the inner circumferential surface 30D of the ring core 30 was doubled, e.g., in a range of 0.22 to 0.3 mm. Also, a conductive wire of φ 0.43 mm with a polyamide imide coating (conductive wire itself was Cu) was used for the winding wire 40, and the number of windings was 15.5. Further, the UV adhesive having a hardness of 40 to 65 Shore D was used as an adhesive that can be cured in a short period of time with respect to the second securing parts 60A, 60B, and the epoxy adhesive having a hardness of 30 or 40 Shore D was used as a thermosetting adhesive used for the first securing parts 62A, 62B. Furthermore, a Cu plate having a thickness of 0.15 mm treated with Ni/Sn plating was used for the terminal electrodes 50A, 50B.

Specific test samples and comparative examples are described below. In this disclosure including the following description, multiple first securing parts are referred to collectively as the "first securing part", and multiple second securing parts are referred to collectively as the "second securing part", depending on the context.

In test sample 1, the dimension of the inner circumferential surface 30D of the ring core 30 was set at 10 mm, for example (the inner diameter can vary in combination with the outer diameter of the flange part and may be about 6 mm, about 10 mm, or the like, for example), the designed gap was set to 0.25 mm, and the design value of the inductance was 15 μH. With respect to the first securing parts 62A, 62B, the number of arrangements was two, the proportion was 40%, and the hardness was 30, and with respect to the second securing part 60 (wherein the second securing parts 60A, 60B, etc. are hereinafter referred to collectively as the second securing part 60), the number of arrangements was one, the proportion was 8%, and the hardness was 40. Also, the comparative example is similar to test sample 1 except that the designed gap was 0.3 mm, the designed inductance value was 14.7 μH, and the second securing part 60 was not provided.

In test sample 2, according to a similar method, the designed gap was 0.25 mm, and the designed value of the inductance was 15 μH. Test sample 2 was produced like test sample 1 except that the proportion was 60% for the first securing parts 62A, 62B. Test sample 3 was produced like test sample 2 except that the proportion was 80% for the first securing parts 62A, 62B, and the hardness was 50 for the second securing parts 60A, 60B.

In test sample 4, according to a similar method, the designed gap was 0.22 mm, and the designed value of the inductance was 15.4 μH. Test sample 4 was produced like test sample 3 except that the proportion was 90% for the first securing parts 62A, 62B, and the number of arrangements was two for the second securing parts 60A, 60B. Test sample 5 was produced like test sample 4 except that the proportion was 100% for the first securing part 62 and the number of arrangements was four, and the proportion was 16% for of the second securing parts 60A, 60B, 60C, 60D. Test sample 6 was produced like test sample 4 except that the hardness was 65 for the second securing parts 60A, 60B.

be viewed was obtained similarly from the upper-surface side or the polished surface. In addition, a Shore hardness test equipment D-type was used for the hardness, and the first and second securing parts were compared. With respect to a specific numerical value of hardness, each hardness was obtained after preparing a test sample having an outer dimension of φ 10 mm and a thickness of 2 mm with an adhesive for forming the second securing part, and performing a predetermined curing.

The variation of the inductance was calculated by a MAX value. The comparative example is an example in which an equivalent of the second securing part of the present example does not exist. Supplementing the inductance evaluation, it should be noted that the variation of inductance is caused by the variation in the gap. In such a case, an entirely even distance is preferably ensured between the outer circumferential surface of the drum core 20 and the inner circumferential surface of the ring core 30, where if the distance is not even, an area of close distance exists causing the inductance to become high. This becomes the variation caused by assembly precision. As the variation of inductance shifts toward the positive side of the designed value, the evaluation performed here obtains the proportion of the

TABLE 1

| | Designed value of size of gap [mm] | Designed inductance value [μH] | Number of securing parts 2nd SP(s) | Number of securing parts 1st SP(s) | Proportion of SPs 2nd SP(s) [%] | Proportion of SPs 1st SP(s) [%] | Hardness shore D 2nd SP(s) | Hardness shore D 1st SP(s) | Inductance variation [%] | Defect after test of 1st SP(s) in heat cycle |
|---|---|---|---|---|---|---|---|---|---|---|
| Comp. | 0.3 | 14.7 | — | 1 | — | 100 | — | 30 | 22 | Interfacial peeling |
| TS 1 | 0.25 | 15 | 1 | 2 | 8 | 40 | 40 | 30 | 16 | Microcrack |
| TS 2 | 0.25 | 15 | 1 | 2 | 8 | 60 | 40 | 30 | 15 | None |
| TS 3 | 0.25 | 15 | 1 | 2 | 8 | 80 | 50 | 30 | 11 | None |
| TS 4 | 0.22 | 15.4 | 2 | 2 | 8 | 90 | 50 | 40 | 9 | None |
| TS 5 | 0.22 | 15.4 | 4 | 1 | 16 | 100 | 50 | 40 | 9 | None |
| TS 6 | 0.22 | 15.4 | 2 | 2 | 8 | 90 | 65 | 40 | 9 | None |

SP: securing part
Comp.: comparative example
TS: test sample

In Table 1, the size of the gap G was calculated as (ring core inner diameter D2−drum core flange part outer diameter D1)/2. Also, the proportion of the lengths of the first securing part and the second securing part making contact with the outer circumferential surface of the flange part 24 of the drum core 20 was indicated with the proportion of the lengths with respect to the outer circumference of the flange part 24 of the drum core 20 seen in a direction of the winding shaft 22 from the flange part 24. In the measurement, an angle of a range in which each of the first and second securing parts exist at the center of the flange part 24 of the drum core 20 was obtained at a magnification of 10 to 20 times using a factory microscope, and the proportion with respect to the entire outer circumference of the flange part 24 was obtained. For the first securing part 62, the angle of the range in which each securing part can be viewed when seen from the upper-surface side corresponding to the direction of the winding shaft 22 from the flange part 24 was obtained at the magnification described above. Moreover, for the second securing parts 60A, 60B, polishing was carried out in a range of 0.05 mm in the vertical direction with respect to the upper surface of the core having a lower height of the flange part 24 of the drum core 20 or the upper surface 30A of the ring core 30, and a range in which the second securing part can difference (size of shift) of the designed value and the maximum value. LCR meter 4285A frequency 100 kHz was used for the measuring instrument. Also, the heat cycle test evaluated the dimensional change before and after the test in 1000 cycles and 3000 cycles at a temperature of −55 to 150° C., and confirmed the presence/absence of change in either cycle. For such check, an area including the first securing part 62 was observed at a magnification of 50 times using a factory microscopic for an appearance change.

The following were confirmed from the results of the comparative example and the test samples shown in Table 1.

In the comparative example, variation in inductance was large. This is because the gap between the two cores has variation at some places when seen over the entire circumference. Also, in the heat cycle test, interfacial stripping was recognized between the drum core 20 or the ring core 30 and the first securing part 62. The thickness of the adhesive thus becomes thin in an area where the gap is large, which leads to defects due to the stress of thermal contraction/expansion.

In test sample 1, variation in inductance decreased even if the designed gap corresponding to the distance between the two cores was reduced. As the second securing parts were provided using the UV adhesive, it was found that the gap precision was satisfactory and that the variation of inductance could be reduced even if the gap was reduced. However, traces of crack were slightly found in the portion at the end in the length direction of the first securing parts 62A, 62B, which were determined to be microcracks. Changes were not found, however, between 1000 cycles and 3000 cycles, and no defects caused by the microcracks were also found. This is because the stress applied on the portion at the end of the first securing part 62 with the second securing part 60A as the trigger when the length in the circumferential direction of the portion where only the second securing part 60A exists was not sufficiently ensured.

In test sample 2, variation in the inductance improved, although slightly. This is because the positional stability was improved with increasing the length in the circumferential direction of the first securing part 62. Also, in test samples 2 to 6, the defects described above were all resolved. This is because the thickness in the height direction of the first securing part 62 was sufficiently ensured by increasing the length in the circumferential direction of the first securing part 62.

In test sample 3, variation in inductance was further reduced. This is because the positional precision further improved by adopting the second securing part 60A having a higher hardness than that of test sample 2.

In test samples 4 to 6, the designed gap was further reduced and variation in inductance was also kept low. This is because gap fluctuation was further reduced by increasing the proportion of the first securing part relative to the second securing part.

Test sample 5 was an example in which the first securing part was provided across the entire circumference, where variation was small and no defects were found in the tested sample size, but it should be taken in consideration that stress applies on a ridge portion of the core if formed across the entire circumference in a small component (smaller than or equal to 7 mm) where rounding of the ridge portion of the ring core 20 is difficult, for example.

According to a comparison between test sample 6 and test sample 4, it should be noted that an upper limit of the hardness of the second securing part does not need to be particularly provided, and no large change is found as long as the Shore D hardness is greater than or equal to 50; higher hardness does not need to be forcibly used and a range of up to about 100 is sufficient.

The examples according to the present invention have the following effects.

(1) The second securing parts 60A, 60B and the first securing part 62 are provided at one part of the gap G of the drum core 20 and the ring core 30, and the second securing parts 60A, 60B having a higher hardness than the first securing part 62 are adopted, so that fluctuation in the distance between the core members can be suppressed.

(2) Defects can be eliminated by setting the proportion of the first securing part 62 with respect to the length of the outer circumference of the drum core 20 to greater than or equal to 60%.

(3) Fluctuation (fluctuation in position between the cores) can be reduced by setting the Shore D hardness of the second securing parts 60A, 60B to greater than or equal to 50 $N/cm^2$.

(4) The second securing part is provided in plural and are arranged opposite to each other with respect to the center C of the drum core 20, so that the gap can be further reduced and the stress applied on the ring core 30 can be evened out, thus reducing variation.

(5) The second securing parts 60A, 60B and the first securing parts 62A, 62B are provided on one flange part 24 side of the drum core 20 opposite the surface (bottom surface part 52B) on which the terminal electrodes 50A, 50B are mounted, and thus the mounting side (bottom surface part 52B) of the terminal electrodes 50A, 50B will not become contaminated.

(6) The first securing parts 62A, 62B cover the upper surface (outer side) of the second securing parts 60A, 60B, and thus the second securing parts 60A, 60B will not detach.

It should be noted that the present invention is not limited to the examples described in this disclosure, and various changes can be made within a scope not deviating from the gist of the invention. This includes, for example, the following.

(1) The shapes and dimensions shown in the above-discussed examples are examples, and may be appropriately changed as needed. For example, in the above-discussed examples, the outer cross-sectional shape of the ring core 30 is an oval shape in which one part of the circle is cut off, but it may be an octagon, a square, and the like, or may be a shape in which a corner is rounded to an extent that rotation does not occur.

(2) The pull-out configuration of the winding wire from the ring core 30 shown in the examples is also an example, and design changes can be appropriately made within a scope that similar effects are obtained.

(3) The shape of the terminal electrodes 50A, 50B shown in the examples and the joining mode with respect to the ends 46A, 46B of the winding wire 40 are also one example, and design changes can be appropriately made within a scope that similar effects are obtained.

(4) In the above-discussed examples, two second securing parts 60A, 60B are provided, but this is also an example, and the number and arrangement can be appropriately changed as long as two or more second securing parts are provided. For example, as in a coil component 10A shown in FIG. 4A, three second securing parts 60A to 60C may be uniformly arranged in the gap G between the drum core 20 and the ring core 30. The stress applied on the ring core 30 can be evenly dispersed by the uniform arrangement. Also, this is the same for a coil component 10C including four second securing parts 60A to 60D shown in FIG. 4C. Moreover, the intervals of a plurality of second securing parts may not be uniform. For example, in a coil component 10B shown in FIG. 4B, three second securing parts 60A to 60C are arranged symmetrically with respect to a line L passing through the center of the drum core 20, but may not be arranged symmetrically and three second securing parts may be arranged completely non-uniformly/asymmetrically. In a coil component 10D shown in FIG. 4D, four second securing parts 60A to 60D are arranged line-symmetrically with respect to the line L. In addition, the second securing parts may be arranged in odd numbers such as three and five, and do not need to be in equal interval arrangement, symmetrical arrangement, or point-symmetric arrangement on a circumference of the gap G, and the arrangement may be determined in view of the shape and the like of the terminal electrode.

(5) In the example, the UV adhesive to become the second securing parts 60A, 60B after being cured is applied to include three members being the outer circumference of the drum core, the inner circumference of the ring core, and the terminal electrode, but this is an example, and the second securing part does not necessarily need to be provided to include the terminal electrode.

(6) In the examples, the first securing parts 62A, 62B are provided to completely cover the upper surface of the second securing parts 60A, 60B, but this is an example, and they do not necessarily need to be arranged to cover the entire second securing part and may partially cover the second securing part. The second securing parts 60A, 60B merely need to at least make contact with either one of the first securing parts 62A, 62B. In either mode, the first and second securing parts will not detach from the component.

(7) Furthermore, in the examples described above, as shown in FIGS. 2A-2 and 4F, a slightly chamfered part 64 is provided at the upper surface of the drum core 20, that is, at the edge of the front surface 24A of the flange part 24, and the thickness of the adhesive is secured using such chamfered part, but this is an example, and design changes can be appropriately made within a scope in which similar effects can be obtained. For example, as shown with a dotted line in FIG. 4F, a tapered part 66, and the like may be provided on the ring core 30 side, and/or the thickness of the adhesive may be ensured using only the slight difference in height of the drum core 20 and the ring core 30, as shown in FIG. 4E (in both FIGS. 4E and 4F, the second securing part such as 60A is not shown as they are cross sections taken along the line L shown in FIG. 4D, for example).

(8) Alternatively, the range of the step differences 36A, 36B for caulking the terminal electrode may be narrowed as in a ring core 70A in the examples shown in FIGS. 5A-1 to 5A-3, or the range of the step differences 36A, 36B for caulking the terminal electrode may be widened as in the examples shown in FIGS. 5B-1 to 5B-3. In either case, the adhesive may be applied so that both ends of the adhesive are located on the step differences 36A, 36B to form the first securing parts 62A, 62B, as shown in FIGS. 5A-3 and 5B-3 to ensure the thickness of the adhesive and stabilize the position of both ends of the adhesive. In particular, in view of the influence of electrical properties due to the step differences 36A, 36B, the step differences 36A, 36B may be formed to a narrow range, and the first securing part may be provided over the step difference 36A, the portion without step differences, and the step difference 36B.

INDUSTRIAL FIELD OF APPLICATION

According to the present invention, a drum core including a pair of flange parts at both ends of a winding shaft, a conductive wire wound around the winding shaft, a ring core having a gap with respect to a flange part when seen in a winding shaft direction from one flange part, the ring core including the drum core in a through hole, a terminal electrode electrically connected to the conductive wire, a first securing part provided at one part of the gap between one flange part of the drum core and the ring core, and a second securing part provided at a part of a portion of the gap where the first securing part is not provided, and having a higher hardness than that of the first securing part are provided. Thus, fluctuation in distance between the drum core and the ring core can be reduced, allowing application to a coil component having both high reliability and stability of properties. In particular, it is suitable for application of a coil component for fields of automobiles and industrial machines as it excels in temperature resistance and impact resistance.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-073417, filed Mar. 31, 2016, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component, comprising:

a drum core having a pair of flange parts at both ends of a winding shaft;

a conductive wire wound around the winding shaft;

a ring core having a through hole housing the drum core therein in a manner providing a gap between an outer surface of one of the flange parts and an inner surface of the ring core which faces the outer surface of the one of the flange parts as viewed in a radial direction, and;

terminal electrodes electrically connected to the conductive wire;

a first securing part provided at a part of the gap between the outer surface of the one flange part of the drum core and the inner surface of the ring core; and a second securing part provided at a part of a portion of the gap where the first securing part is not provided, and having a higher hardness than that of the first securing part, wherein the first securing part covers and directly contacts an upper side of the second securing part in the gap as viewed in an axial direction of the winding shaft where a direction from another of the flange parts toward the one of the flange parts is defined as an upward direction.

2. The coil component according to claim 1, wherein a length of the first securing part in contact with an outer circumferential surface of the flange part of the drum core is greater than or equal to 60% of a length of the outer circumferential surface of the flange part of the drum core.

3. The coil component according to claim 1, wherein a hardness of the second securing part is greater than or equal to 50 $N/cm^2$ in Shore D hardness.

4. The coil component according to claim 2, wherein a hardness of the second securing part is greater than or equal to 50 $N/cm^2$ in Shore D hardness.

5. The coil component according to claim 1, wherein at least two or more second securing parts are provided.

6. The coil component according to claim 5, wherein at least two of the second securing parts are arranged at positions opposite to each other with respect to a center of the drum core.

7. The coil component according to claim 5, wherein the second securing parts are arranged line-symmetrically with respect to a line passing through a center of the drum core.

8. The coil component according to claim 5, wherein the second securing parts are arranged at equal intervals.

9. The coil component according to claim 1, wherein the first securing part and the second securing part are arranged on a flange part side opposite to a surface on which the terminal electrode is mounted.

10. The coil component according to claim 1, wherein the first securing part is made of a thermosetting adhesive, and the second securing part is made of a UV adhesive.

* * * * *